United States Patent [19]

Willinger

[11] 4,340,625

[45] Jul. 20, 1982

[54] ARTIFICIAL AQUARIUM PLANT

[75] Inventor: Allan H. Willinger, Englewood, N.J.

[73] Assignee: Willinger Bros., Inc., Englewood, N.J.

[21] Appl. No.: 207,342

[22] Filed: Nov. 17, 1980

[51] Int. Cl.[3] ..... A41G 1/00; A47G 7/00

[52] U.S. Cl. ..... 428/17; 47/40.5; 248/27.8

[58] Field of Search ..... 119/5; 428/19, 17, 26; 248/27.8; 47/40.5

[56] References Cited

U.S. PATENT DOCUMENTS

| | | | |
|---|---|---|---|
| 1,870,208 | 8/1932 | Crosser | 428/17 X |
| 2,609,169 | 9/1952 | Kroeger | 47/40.5 |
| 3,137,610 | 6/1964 | Flynn | 428/26 |
| 3,573,142 | 3/1971 | Chidgey et al. | 428/474.9 X |
| 3,576,698 | 4/1971 | Chidgey et al. | 428/17 |
| 3,682,753 | 8/1972 | Willinger | 428/20 X |
| 3,744,454 | 7/1973 | Willinger et al. | 428/17 X |

FOREIGN PATENT DOCUMENTS

| | | | |
|---|---|---|---|
| 1024152 | 3/1966 | United Kingdom | 428/26 |
| 2035789 | 6/1980 | United Kingdom | 428/19 |

*Primary Examiner*—Henry F. Epstein

*Attorney, Agent, or Firm*—Friedman, Goodman & Teitelbaum

[57] ABSTRACT

An artificial aquarium plant having a base member and a plant member interfitting into the base member. The plant member is formed of a plurality of plant sections nestingly interfitting within each other. Preferably, the base member is formed with pivotal arms movable between a radially outwardly extending position and a contracted position when the arms are adjacent to and embracing the periphery of the base member. Preferably, the plant sections are formed of polystyrene and are secured together by applying a ketone material in order to solvent bond the parts together.

13 Claims, 7 Drawing Figures

ARTIFICIAL AQUARIUM PLANT

BACKGROUND OF THE INVENTION

This invention relates to an aquarium decoration, and more particularly to an artificial aquarium plant with improved display capabilities.

Artificial aquarium plants are generally utilized for decorating an aquarium. Such plants provide a natural appearance to the aquarium, providing color and interest which add to the aesthetic appeal of the aquarium. Additionally, the use of the plants provide physical advantages such as protection of newly hatched fish and the protection of smaller fish.

Numerous types of artificial aquarium plants are readily available. Frequently these are displayed in pet shops and departments, and are purchased by the user because of their beauty, size, and other physical qualities. Accordingly, it is important to be able to display the plant in a manner that is attractive in order for the hobbyist to purchase a particular plant. At the same time, the plant should also be able to be easily installed in the aquarium tank so that it maintains its upstanding appearance.

It is therefore necessary that the artificial plant be physically structured such that it can be displayed on a shelf in an attractive upstanding manner and maintain such appearance during actual use in the aquarium. During such actual use, the plant is subject to continuous disturbances. Although the plant may be anchored in sand and gravel, nevertheless there is continuous tendency to dislodge the plant by means of foraging fish, water turbulence generated by aeration and filter devices, as well as by the hobbyest himself while servicing the aquarium. The problem of dislodgement is of special concern with larger type plants which require even greater support in the aquarium tank and have a greater tendency to become loosened from their anchorage.

Most of the artificial aquarium plants are formed of various types of plastic materials which are given color and physical properties to resemble a natural plant. As a result, the artificial aquarium plants are usually formed of various parts which can be assembled together. However, because of the requirement for assembly, there generally results the additional requirement that suitable means are needed to maintain the assembly together in a secure, firm, and fastened position so that the plant assembly will not come apart during shipping, display, or actual use thereof.

SUMMARY OF THE INVENTION

Accordingly, it is an object of the present invention to provide an artificial aquarium plant which avoids the problems of prior art devices.

Another object of the present invention is to provide an artificial aquarium plant which provides improved characteristics for display purposes.

Yet another object of the present invention is to provide an artificial aquarium plant which provides an upstanding stiff appearance to facilitate a decorative display of the physical characteristics of the plant.

A further object of the present invention is to provide an artificial aquarium plant formed of a number of sections which can be easily assembled and maintained in a rigid upstanding fashion.

Yet a further object of the present invention is to provide an artificial aquarium plant formed of nestingly interfitting plant sections to permit the formation of a plant of a desired height and shape.

Another object of the present invention is to provide an artificial aquarium plant formed of a combination of plastic materials which facilitates assembly of the part and provides an upstanding rigid appearance of the plant.

Yet another object of the present invention is to provide an artificial aquarium plant having an improved base portion which can be utilized for supporting large and wide plants.

Still another object of the present invention is to provide a method of fabricating an artificial aquarium plant permitting the assembly of various parts into a rigid secure plant structure.

In accordance with the features of the present invention, the above objects are accomplished by providing an artificial aquarium plant comprising a base member and a plant member. The base member has a receptacle which receives the plant member and supports it in an upstanding manner on the base member. The plant member comprises a plurality of plant sections nestingly interfitting within each other. Each of the plant sections has a respective trunk portion from which extends respective stem portions, there being a leaf portion secured to the end of each stem portion.

In accordance with another feature of the present invention, the base member comprises a saucer shaped dish having a bottom wall and an upstanding peripheral side wall. Preferably, a plurality of arms are provided on the dish. Pivotal means are included which respectively couples each arm to the dish so as to permit swinging of the arms between an extended and retracted position. In the extended position, the arms subtantially radially extend from the dish providing additional base support and serving as additional scoops for holding sand and gravel to anchor the plant. In their retracted position, the arms embrace the periphery of the dish so as to provide a compact arrangement for shipping and storage purposes.

In accordance with another feature of the present invention, there is provided a method of fabricating the artificial aquarium plant. The trunk and stem portions of the plant are formed of butadeine or like rubber filled polystyrene and are assembled together. They are then inserted into the base member, which is formed of a high impact polystyrene. The assembled parts are then dipped in a lacquer thinner containing ketone material. Such ketone material acts as a solvent to bond the parts together in that the parts are melted and thus fused into a rigid assembly. The leaf portions of the plant, formed of a low density polyethylene, are secured to the stem portions.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing like reference characters designate like parts.

DETAILED DESCRIPTION OF THE PREFERRED EMBODIMENT

Figure 1:
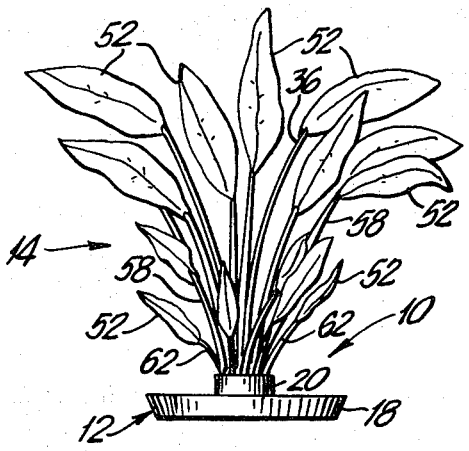
FIG. 1 is an elevational view of an artificial aquarium plant according to the present invention, being shown in an assembled condition.
Figure 2:
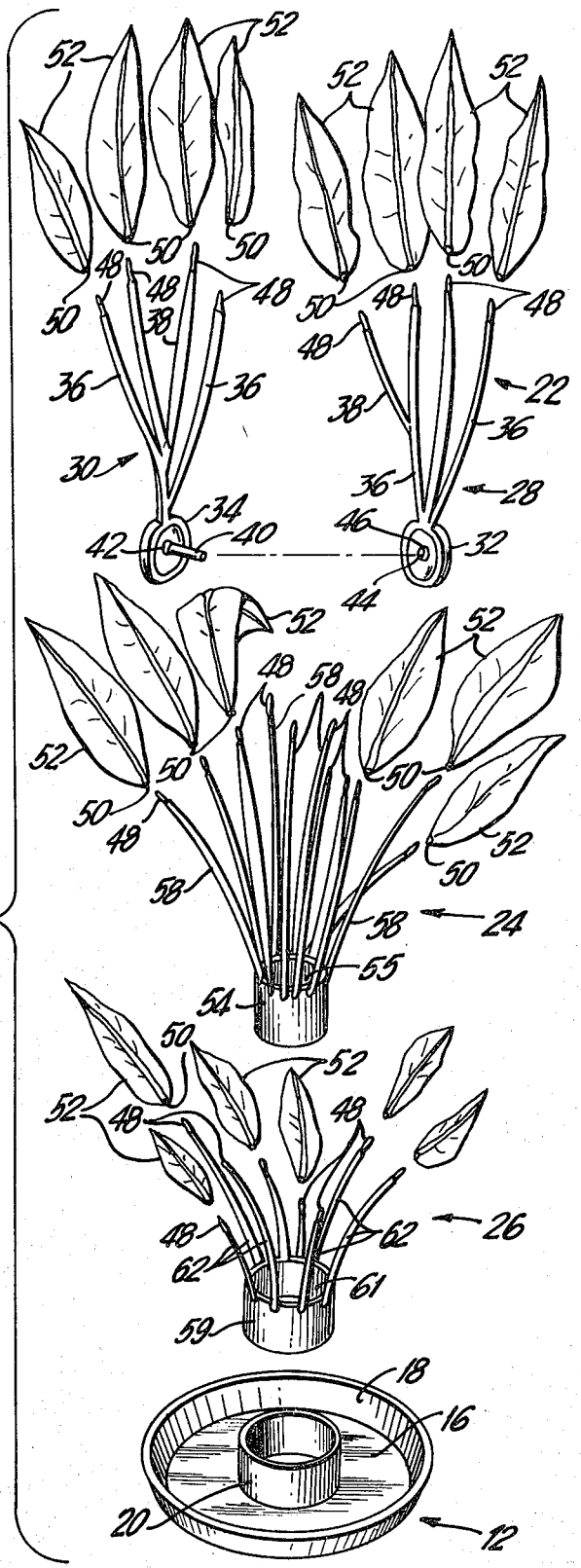
FIG. 2 is an exploded perspective view of the plant of the present invention.
Figure 3:
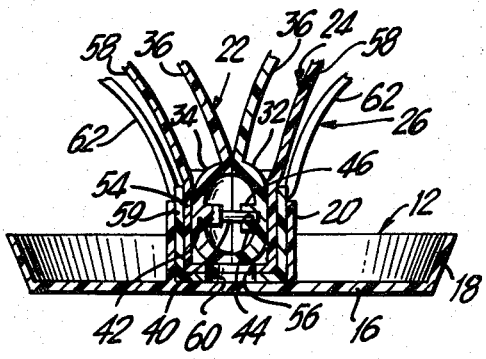
FIG. 3 is a sectional elevational view showing the interconnection between the plant member and the base member.

Referring now to FIGS. 1-3, the artificial plant in accordance with the present invention is shown generally at 10 and is formed of a base member, shown generally at 12, and a plant member, shown generally at 14. The base member is shaped as a saucer or dish and includes a bottom wall 16 with an upwardly extending, outwardly flared side wall 18 about the periphery of the bottom wall 16. A centrally located sleeve 20 defines a receptacle for receiving a trunk portion of the plant member, as will hereinafter be described. The bottom of the sleeve 20 is closed by the bottom wall 16 as shown in FIG. 3.

The plant member 14 is formed of a plurality of plant sections, three sections being shown at 22, 24, and 26. The three plant sections are formed with each being gradually larger than the previous one, and with the sections being nestingly interfitting with each other. Each of the sections include a lower trunk portion from which extend stems which in turn support leaves. However, the first or innermost section 22 is formed slightly different than the other two sections.

The innermost section 22 is formed of two matingly engaging halves 28, 30. t the lower portion of each half there is provided a substantially oval cup-shaped member 32, 34 from which upwardly extend the stems 36. The stems radiate from the upper portion of each oval cup-shaped member in a fan-like manner. In some cases, one stem can actually extend from another stem, as shown at stem 38. To facilitate assembly of the two oval cup-shaped members 32, 34 into a composite hollow unit, a male connecting pin 40 outwardly extends from the inner surface of the oval cup-shaped member 34 and is connected thereto at a boss 42. A receiving bore 44 is formed in a boss 46 on the inner surface of the complementary oval cup-shaped member 32. The male connecting pin 40 is received in the bore 44, preferably by means of a press fit, so that the confronting walls of the oval cup-shaped members abut against each other to enclose the pin 40 therein. However, such press fit is not necessarily required, as will be shown below.

At the distal ends of each of the stems 36, 38, there are provided spear-like connectors 48 which are inserted into receiving sockets 50 at the end of the leaves 52. A snap force fit is preferably provided between each spear-like connector 48 and each associated receiving socket 50 in order to retain the leaf suitably in place at the end of its associated stem.

The next intermediate plant section 24 includes a tubular trunk member 54 having an open top end 55 and an opening 56 in the bottom wall thereof, as shown in FIG. 3. Upwardly extending and outwardly flared from the upper peripheral end of the trunk member 54 are additional stems 58. At the distal ends of the trunk member stems 58 are provided the spear-like connectors 48 which again are received in sockets 50 of the leaves 52, in the same manner as mentioned above to secure the leaves to the stems.

The next outer plant section 26 includes a wider tubular trunk member 59 which has an open top end 61 and an opening 60 formed in the bottom wall thereof, as shown in FIG. 3. Outwardly flared and upwardly extending additional stems 62 are formed at the upper peripheral end of the trunk member 59. Spear-like connectors 48 at the ends of the stems 62 are again utilized to be fastened within the sockets 50 of the leaves 52, in the same manner as mentioned above to secure the leaves to the stems.

It should be appreciated that the trunk member 59 of the third section 26 has a larger diameter than the trunk member 54 of the second section which in turn has a larger diameter than the mated oval members 32, 34 forming the composite hollow unit. As a result, a nesting interfitting relationship is achieved whereby the first section 22, when assembled, will have its oval composite unit inserted into the trunk member 54, which in turn can fit into the trunk member 59. Such nesting interrelationship is best shown in FIG. 3.

It should also be noted that preferably, the length of the stems 36 of the innermost section 22 is higher than the stems 58 of the intermediate section 24, which in turn are higher than the stems 62 of the third outer section 26. Similarly, in that the innermost section 22 is closer towards the center and the subsequent sections 24, 26 are added thereabout, the leaves of the subsequent sections are respectively outwardly flared to a greater extent. In this manner when all the sections are assembled, a structure is achieved as shown in FIG. 1 with various levels and layers of stems and leaves formed thereby. When the sections are all interconnected, the openings 56, 60 in the trunk members 54, 59 will be aligned, as shown in FIG. 3.

Typically, the aquarium plant 10 will be formed of plastic material and the various parts of each section will be integrally molded. For example, the stems 36, 38 extending from the oval members 32, 34 are integrally molded with the respective oval half. Similarly, the stems 58 are integrally molded with the trunk member 54, and the stems 62 are integrally molded with the trunk member 59.

Preferably, the leaves 52 are formed of a low density polyethylene material. The trunk members 54, 59, the oval members 32, 34 and the stems 36, 38 and 62 extending from each are formed of a rubber filled polystyrene, such as butadeine filled polystyrene. The base member 12 can be formed of a high impact polystyrene material. In order to provide the desired plant structure, the parts are assembled by first combining the two halves 28, 30 to form the inner plant section 22. This in turn is interfitted into the intermediate plant section 24, which in turn is fitted into the outer section 26. It should be understood that additional plant sections could also be provided and a similar interfitting and nesting relationship would be achieved.

With the various plant sections combined into the plant member 14 as set forth above, the plant member 14 is inserted into the receptacle formed by the sleeve 20 on the base member 12. However, before the plant is positioned in the sleeve 20, the trunk member end of the plant is first dipped into a lacquer thinner of ketone material. Thus, when the turn member end is inserted into the sleeve 20, the material will spread around the various parts of the sleeve 20 and the trunk members 54, 59 and through the openings 56, 60 to oval unit 32, 34 to fuse the parts together forming a solvent bond between the sleeve 20, the trunk members 54, 59 and oval unit 32, 34 to form an integral assembly.

Once assembled, the material forming the plant will make it a rigid upstanding plant which can maintain its shape in a packaged condition. As a result, the plant can be retained assembled, as shown in FIG. 1, and placed in a package. Furthermore, the plant can stand upright on a shelf and maintain its attractiveness so that hobbyists will be able to select a suitable plant in accordance with their desires. At the same time, the plant will also retain its upright position when placed in an aquarium tank.

When placed in an aquarium tank, the base member 12 forms a dish which receives the conventional gravel and sand therein to provide anchorage for the artificial plant. The gravel and sand would fill onto the bottom wall 16 and be contained within the dish by the peripheral side wall 18.

As can be appreciated, because the plant of the present invention is formed of nesting interfitting sections, the height and width of the plant can be made substantially large. In some cases, the base member 12 heretofore described will not have sufficient breadth in order to support the plant member. A wider base would be desired. However, such wider base would take up more room on a display and would require more packaging space.

In order to provide a wider base and at the same time avoid the loss of display space, reference is made to the embodiment of the base member shown in FIGS. 4–7. The base member is shown generally at 64 and is formed in a saucer or dish-like shape including a bottom wall 66 and an upwardly extending, outwardly flared peripheral side wall 68. The space defined between the bottom and side walls can receive gravel or sand for anchorage of the plant at the bottom of the aquarium. An upstanding circular sleeve 70 is formed proximate the center of the bottom wall 66 and defines a receptacle opening 72 which can receive the trunk member end of a plant of the type previously described in connection with FIGS. 1–3. The bottom of the sleeve 70 is closed by the bottom portion 73 of the bottom wall 66.

Figure 4:
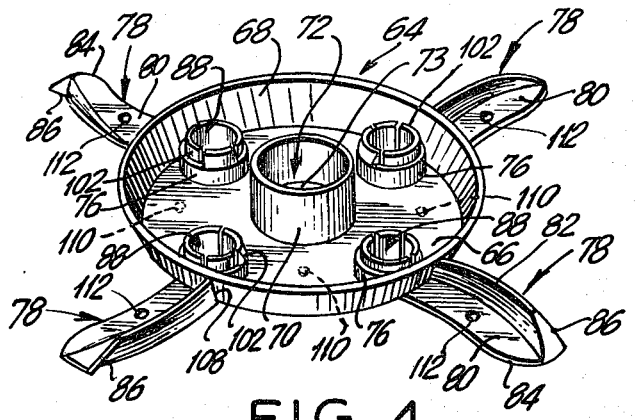
FIG. 4 is a perspective view of another embodiment of the base member showing the arms in an extended condition.
Figure 5:
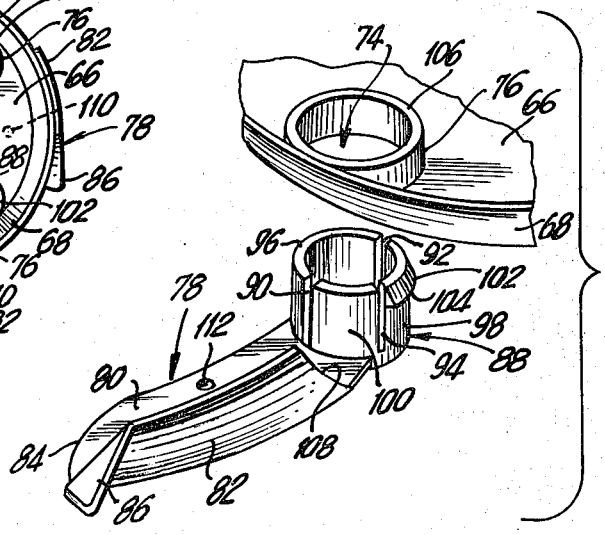
FIG. 5 is a fragmented perspective exploded view showing the pivotal interconnection parts of the base member of FIG. 4.

Peripherally positioned about the center sleeve 70 are formed a plurality of satellite bores 74 each of which has a peripheral sleeve 76 thereabout. It should be noted that the center sleeve 72 is closed by the solid bottom wall, while the satellite sleeves 76 are open at both ends by the bores 74 extending therethrough. As best shown in FIGS. 4 and 5, there are provided a plurality of arms, shown generally at 78, including a base wall 80 of slightly arcuate shape, with an upstanding rear wall 82 also of such arcuate shape. The distal end of the base wall 80 is arcuately curved at 84. The distal end of the rear wall 8 is outwardly flared at 86 to define a finger grip or lip.

At the inner end of the arm 78, there is formed an axially extending hollow shaft 88. A series of axially extending slots 90, 92, 94, are arcuately spaced apart and separate the shaft into a plurality of shaft sections 96, 98, 100. It should be appreciated that the slots do not extend through the entire axial height of the shaft, and give the shaft a slightly resilient nature.

At the upper edge of the shaft section 98 there is formed an outwardly flared cam surface 102 which terminates in a radially extending locking ridge 104. The height of the shaft 88 is greater than the height of the sleeve 76, and being more particularly a height such that the locking ridge 104 of the shaft 88 can sit on the upper edge 106 of the sleeve 76. Each inner edge 108 of the rear walls 82 of the arms 78 terminates at a distance from the shaft 88 and is arcuately formed to conform to the outward flare of the peripheral wall 68 of the dish-like base member 64, as shown in FIG. 4.

Figure 7:
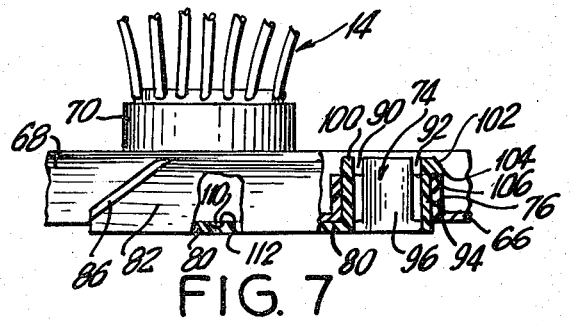
FIG. 7 is a partially sectional elevational view of the base member shown in FIG. 4.

The hollow shaft 88 is pressed into the bore 74 from beneath the base member until the locking ridge 104 sits on the upper edge 106 of the sleeve 76, as shown in FIG. 7. Because of the axially extending slots 90, 92, 94, the shaft 88 is slightly resilient to facilitate entry into the sleeve 76. Also, because of the cam surface 102, the locking ridge 104 will easily enter the sleeve 76, but will be prevented from being removed from the sleeve once the locking ridge 104 is snapped into position on the upper edge 106.

Figure 6:
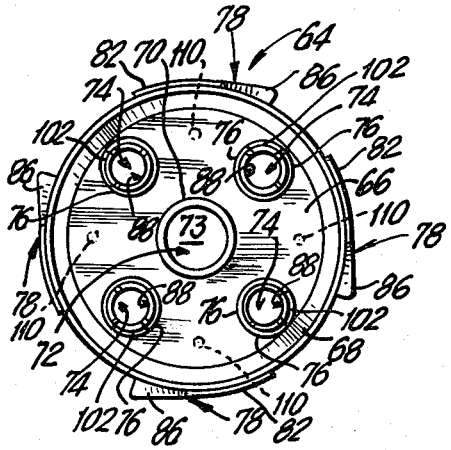
FIG. 6 is a top plan view of the base member shown in FIG. 4 with the arms in a contracted position.

Once inserted, pivotal movement is permitted between the arm 78 and the base member dish. In the contracted position, as shown in FIG. 6, the arms are adjacent to the dish and embrace the peripheral side wall 68 of the dish. It should be noted that the general shape of the arms is arcuate to conform to the shape of the peripheral side wall 68 of the dish, and that the rear walls 82 of the arms are also outwardly flared to conform with the outward flaring of the peripheral side wall 68 of the dish. In this way, when in the contracted position, the arms will lie snugly against the peripheral side wall 68 of the dish.

In the extended position, as shown in FIG. 4, the arms 78 substantially radially extend from the dish. When pivoting the arms to the extended positions, the arms continue their outward radial movement until the inner edge 108 of the rear wall 82 is stopped by abutting against the peripheral side wall 68 of the dish. The finger grip 86 at the distal end of the arm provides a finger grip for facilitating the pivotal movement of the arms from their contracted position shown in FIG. 6 to their extended position shown in FIG. 4.

In the extended position, the arms provide a wider base for additional support of the plants. Furthermore, the base wall 80 and the rear wall 82 of the arms define a scoop for the sand or gravel to thus provide further anchorage of the plant in the aquarium tank. In this manner, the plant can be packaged, shipped and stored with the arms in their contracted position in order to save space. However, when on display or in use, the arms can be extended to provide additional support and better anchorage of the plant.

In order to maintain the arms in their contracted position, arcuately spaced apart, downwardly extending pips or protrusions 110 are provided on the underside of the bottom wall 66 of the dish. The pips lie in a common circumference adjacent the outer periphery of the dish and a single pip is used for each arm. A corresponding recess 112 is formed in the upper surface of the base wall 80 of each arm for receiving a respective pip to define detent means. With the arms in the contracted position, the pips 110 enter the recesses 112, as shown in FIG. 7, and maintain the arms 78 in such position.

The particular base shown in FIGS. 4–7 is utilized with the plant member 14 of the type shown in FIGS. 1–3. Alternatively, other types of plant members can be utilized, whereby the bottom portion of these plant members would be received in the receptacle opening 72 formed in the base member 64.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. An artificial aquarium plant comprising:

a base member having a receptacle, and a plant member upstandingly insertable in said receptacle for support by said base member;

said plant member including a plurality of plant sections nestingly interfitting within each other, each plant section having a respective trunk portion from which extends respective stem portions, said trunk portion of each of said plant sections being disposed in said receptacle of said base member in an assembled condition of said plant sections;

said trunk portion of an innermost plant section being a body member, said trunk portion of each of the other plant sections being a tubular portion, the tubular portions of succeeding plant sections sequentially fitting into each other;

said innermost plant section including two matingly engaging opposing section halves, each section half including a semi-oval portion with stem portions upwardly extending therefrom;

a connecting pin extending perpendicularly from an inner surface of one semi-oval portion and a cooperating receiving bore provided in an inner surface of the other semi-oval portion, said connecting pin being disposed in said receiving bore to matingly join said section halves together to define said body member; and said body member fitting into the tubular portion of the first succeeding plant section with said stem portions of said body member extending upwardly and outwardly from said first succeeding plant section.

2. An artificial aquarium plant as in claim 1, and further comprising an aperture provided in a bottom wall of each tubular portion, said apertures being aligned in the assembled condition of said plant sections.

3. An artificial aquarium plant as in claim 1, wherein the stem portions of said other plant sections extend upwardly in an outwardly flared direction from an upper peripheral edge of the respective tubular portion of that plant section.

4. An artificial aquarium plant as in claim 1, wherein stem portions of respective plant sections are sequentially shorter and more outwardly flared starting from said outermost plant section so that said stem portions are longer and less outwardly flared on said innermost plant section.

5. An artificial aquarium plant as in claim 1, and further comprising spear-like connectors provided at distal ends of the stem portions, and leaves having sockets therein receiving a corresponding spear-like connection so that said leaves are connected to the distal ends of said stem portions.

6. An artificial aquarium plant as in claim 5, wherein said base member is fabricated from a high impact polystyrene material, said plant sections are fabricated from a rubber filled polystyrene material, and said leaves are fabricated from a low density polystyrene material.

7. An artificial aquarium plant as in claim 6, wherein said plant sections are fabricated from a butadeine filled polystyrene material.

8. An artificial aquarium plant assembly comprising a dish shaped base member and a plant member upstandingly supported on said base member, said base member including a dish having a receptacle for receiving said plant member therein and a plurality of support arms disposed around said base member, said dish having a bottom wall and an upstanding peripheral side wall, said arms being disposed against the outer surface of said side wall, and pivot means for respectively coupling each arm to said bottom wall of said dish to permit swinging of said arms between an extended position with said arms radially extending from said peripheral side wall of said dish to support said artificial aquarium plant and a retracted position with said arms embracing said peripheral side wall of said dish.

9. An artificial aquarium plant assembly as in claim 8, wherein said pivot means includes a plurality of satellite positioned bores provided in said bottom wall, an upstanding axially extending sleeve provided about each bore, an axially extending shaft provided on an inner end of each of said arms for respective rotation within a corresponding sleeve, and an outwardly extending lip provided at an upper end of at least a peripheral section of each shaft for resting on an upper edge of the corresponding sleeve to pivotally lock each arm in its respective bore.

10. An artificial aquarium plant assembly as in claim 9, wherein each of said shafts is hollow, and further comprising axially extending angularly spaced apart slots provided in each of said shafts to facilitate entry of each shaft into its corresponding sleeve, said slots defining shaft sections therebetween, said lip being provided on one of said shaft sections, and said lip including a radially extending cam surface terminating in a radially extending locking ridge, whereby each of said shafts can be inserted into and locked within a corresponding sleeve.

11. An artificial aquarium plant assembly as in claim 9, wherein each arm includes a base wall having an upstanding curved rear wall corresponding to a peripheral curvature of said dish, an inner end of said rear wall terminating in spaced relationship from said shaft to provide a stop to the pivotally extended position of said arm, and a distal end of said rear wall terminating in an outwardly flared finger grip to facilitate manipulation of said arm.

12. An artificial aquarium plant assembly as in claim 8, wherein said dish includes angularly spaced apart locking pips downwardly extending from said bottom surface of said bottom wall of said dish and lying in a common circumference adjacent an outer periphery of said dish, corresponding recesses provided on each arm for receiving a respective locking pip to hold said arms in said retracted position.

13. An artificial aquarium plant assembly as in claim 8, wherein said base member is fabricated from a high impact polystyrene material.

* * * * *